US005158301A

United States Patent [19]

Martukovich, Jr.

[11] Patent Number: 5,158,301

[45] Date of Patent: Oct. 27, 1992

[54] FOOTBALL BOARD GAME

[76] Inventor: Joseph J. Martukovich, Jr., 230 Paul St., Bedford, Ohio 44146-4651

[21] Appl. No.: 575,184

[22] Filed: Aug. 29, 1990

[51] Int. Cl.[5] ..... A63F 3/00

[52] U.S. Cl. ..... 273/247; 273/94

[58] Field of Search ..... 273/247, 259, 94 R

[56] References Cited

U.S. PATENT DOCUMENTS

| | | | |
|---|---|---|---|
| 3,043,594 | 7/1962 | Seitz | 273/247 |
| 3,547,441 | 12/1970 | Thornton | 273/94 R |
| 3,554,548 | 6/1971 | Isom | 273/94 R |
| 3,724,852 | 4/1973 | Payne, Jr. | 273/94 R |
| 3,730,528 | 5/1973 | Corrado | 273/247 |
| 3,807,734 | 4/1974 | Lowther | 273/94 R |
| 3,809,405 | 5/1974 | Friedman | 273/94 R |
| 3,814,426 | 6/1974 | Moe | 273/94 R |
| 3,833,220 | 9/1974 | Schurdell | 273/94 R |
| 3,869,122 | 3/1975 | Payne, Jr. et al. | 273/94 R |
| 3,887,191 | 6/1975 | Lucas | 273/247 |
| 3,947,039 | 3/1976 | Sadler et al. | 273/247 |
| 3,995,863 | 12/1976 | Cummins | 273/94 R |
| 4,003,580 | 1/1977 | Haffey, Jr. | 273/247 |
| 4,017,075 | 4/1977 | Wilson | 273/94 R |
| 4,019,737 | 4/1977 | Witzel | 273/94 R |
| 4,094,509 | 6/1978 | Barron | 273/247 |
| 4,169,600 | 10/1979 | Rakowski | 273/247 |
| 4,173,346 | 11/1979 | Godwin | 273/247 |
| 4,183,529 | 1/1980 | Hunson | 273/94 R |
| 4,203,605 | 5/1980 | Moody | 273/247 |
| 4,211,410 | 7/1980 | Smith | 273/94 R |
| 4,252,321 | 2/1981 | Hopwood | 273/247 |
| 4,285,521 | 8/1981 | Joel, III | 273/247 |
| 4,478,419 | 10/1984 | Maiers | 273/259 |
| 4,524,975 | 1/1985 | Caughie et al. | 273/247 |
| 4,660,836 | 4/1987 | Rhome | 273/247 |
| 4,706,959 | 11/1987 | Price | 273/247 |
| 4,773,650 | 9/1988 | Doughty | 273/247 |

*Primary Examiner*—Benjamin Layno

*Attorney, Agent, or Firm*—Fay, Sharpe, Beall, Fagan, Minnich & McKee

[57] ABSTRACT

A simulated football game apparatus includes a game board on which is depicted a standard football playing field, and a game piece movable on the game board to indicate the position of the football on the playing field. A first set of playing cards is provided with each card representing an offensive player. A second set of playing cards is provided with each card representing a defensive player. Each card of the two sets of cards includes a group of numbers. A chance number selector operates on each play to produce a first number corresponding to one of the group of numbers on the cards. A team tendencies booklet indicates the relative strengths of an offense and a defense of a first team in relation to a second team of the teams facing each other. A plurality of first charts is provided, each of which is divided into a plurality of sections including a group of numbers for a particular play such as a pass play attempted at a particular section of the field. The result of the given play is determined by the first number produced by the selector, the first number corresponding to a second number which is one of the group of numbers on one of the playing cards and the second number in turn corresponds to a third number which is one of the group of numbers on one of the first charts to secure the result of a play.

25 Claims, 26 Drawing Sheets

FIG. 4

TEAM 1

WEEK: 6

AT

TEAM 2

160

162

164

| | | OFF. GRADE | | | RETURN GRADE |
|---|---|---|---|---|---|
| OFF: 45 | TEAM 1 | B | KO: B | PUNT: C | KR: C |
| DEF: 30/29 | | | KR: B | PR: C | PR: C |
| OFF: 43 | TEAM 2 | B/A | KO: A | PUNT: A | KR: C |
| DEF: 54/53 | | | KR: C | PR: A | PR: A |

166 FUMBLE:

| FOR OFFENSE: | (FRN) | (RANGE) |
|---|---|---|
| TEAM 1 | 11–48 | OFF: 11–48 |
| | | 51–88 |
| TEAM 2 | 11–48 | OFF: 11–48 |
| | | 51–88 |

168 PENALTY:

| | (RANGE) |
|---|---|
| TEAM 1 | 11–48 |
| TEAM 2 | 51–88 |

170 SACK:

| | (RANGE) |
|---|---|
| TEAM 1 | 11–68 |
| TEAM 2 | 11–68 |

172 INT:

| | (RANGE) |
|---|---|
| TEAM 1 | 11–68 |
| TEAM 2 | 11–68 |

174

| TIME–OUTS | PLAYS |
|---|---|
| T-1 – | 1– |
| T-2– | 2– |
| T-1 – | 3– |
| T-2– | 4– |
| | OT– |

| | 1 | | | 2 | | |
|---|---|---|---|---|---|---|
| | A | B | C | A | B | C |
| 1 | LR | LR | LR | LR | LR | LR |
| 2 | 34 | 31 | 29 | 35 | 30 | 28 |
| 3 | 31 | 250B | 220B | 33 | 29 | 26 |
| 27 | 5 | 4 | 2 | 4 | 3 | 2 |
| 47 | | | | | | |
| 48 | C–12 | FC2(I) | C–12 | 4(X) | C–12 | 6(XX) |

FIG. 8

118 SHORT PASS D.9 – D.G.

116 SHORT PASS D.34 – D.10

114 SHORT PASS 0.21 – D.35

112 SHORT PASS 0.G. – 0.20

| | 1 | | | 2 | | |
|---|---|---|---|---|---|---|
| | A | B | C | A | B | C |
| 1 | | | | | | |
| 8 | 5–6 | 5–5 | 9–0 | 6–6 | 10–1 | 8–1 |
| 18 | 2–(–1) | INC | INC | 1–0 | INC | INC |
| 39 | QF | –11 | QF | –11 | QF | –15 |
| 48 | | | | | | |

FIG. 9

128 MEDIUM PASS D.29 – D.13

126 MEDIUM PASS D.49 – D.30

124 MEDIUM PASS 0.21 – 50

122 MEDIUM PASS 0.G. – 0.20

| | 1 | | | 2 | | |
|---|---|---|---|---|---|---|
| | A | B | C | A | B | C |
| 1 | | | | | | |
| 2 | MP | 11–21 | 12–16 | MP | MP | 27–2 OB |
| 42 | FC9 | FC9 | FC9 | FC9 | FC9 | FC9 |
| 43 | FC9 | FC9 | FC9 | FC9 | FC9 | FC9 |
| 48 | C–15 | C–15 | 11–0(XX) | 15–9(X) | INC(X) | C–15 |

FIG. 10

140 SCREEN PASS 0.21 – D.35

136 LONG PASS D.49 – D.30

134 LONG PASS 0.21 – 50

132 LONG PASS O.G. – 0.20

| | 1 | | | 2 | | |
|---|---|---|---|---|---|---|
| | A | B | C | A | B | C |
| 1 | | | | | | |
| 5 | 19–27 | 21–22 | 20–17 | 20–23 | 23–17 OB | 16–20 |
| 23 | INC | INT4 | INT4 | INC | INT4 | INT4 |
| 48 | 38–0(I) | 48–4(X) | 31–6(X) | C–15 | 45–21(XI) | FC11(II) |

FIG. 11

219

3 MINUTE DRILL D.20 – D.G.

3 MINUTE DRILL D.50 – D.21

3 MINUTE DRILL O.G. – O.49

| | 1 | | | 2 | | |
|---|---|---|---|---|---|---|
| | A | B | C | A | B | C |
| 1 | | | | | | |
| 4 | 35–0 OB | 25–6 | 25–0 | 31–3 OB | 24–8 OB | 23–1 |
| 39 | –11 | –12 | QF | QF | QF | –15 |
| 48 | C–11 | 10–2(XX) | –13(X) | MP(XX) | INT3(XI) | C–11 |

FIG. 12

146 PENALTY CHART

145 FUMBLE + BLOCKED KICK CH.

144 FUMBLE + BLOCKED KICK CH.

143 FUMBLE REC./BL. KICK RET.

142 INTERCEPTED PASS RET.

141 INTERCEPTION TABLE

INDICATOR CHART

| | A | B | C | D | E | F | G | H | I | J |
|---|---|---|---|---|---|---|---|---|---|---|
| | 1–32 | 33–48 | 49–64 | 65–80 | 81–96 | 97–112 | 113–128 | 129–144 | 145–160 | 161–176 |
| 1 | 1 | 1 | 1 | 1 | 2 | 2 | 2 | 2 | 3 | 3 |
| 18 | 4 | 6 | 8 | 10 | 12 | 14 | 16 | 18 | 20 | 22 |
| 21 | 5 | 7 | 9 | 11 | 14 | 16 | 18 | 20 | 23 | 25 |
| 28 | 8 | 12 | 16 | 20 | 24 | 28 | 32 | 36 | 40 | 44 |
| 88 | 32 | 48 | 64 | 80 | 96 | 112 | 128 | 144 | 160 | 176 |

FIG. 14A

SCORESHEET

THE ADVANCED VERSION

WEEK: 6

200

TEAM 1

AT

TEAM2

WEATHER: CHART– NA
NOTE(S)–

202

204

SPECIAL TEAMS (GRADES)

| | FIELD | QUARTER ADJ. | | 1 | 2 | 3 | 4 | |
|---|---|---|---|---|---|---|---|---|
| OFF: 45 | −4 | TEAM 1 | O– | −5 | +5 | 0 | +5 | KO: B PUNT: C |
| DEF: 30/29 | | | D– | 0 | 0 | 0 | 0 | KR: B PR: C |
| OFF: 43 | +4 | TEAM 2 | O– | 0 | +5 | 0 | 0 | KO: A PUNT: A |
| DEF: 54/53 | | | D– | 0 | −5 | 0 | 0 | KR: C PR: A |

208

| ADJ. TOTAL | NUM. RAT. (FINAL) | | 1 | 2 | 3 | 4 |
|---|---|---|---|---|---|---|
| O– 45−4 =41 | TEAM 1 | O– | 36 | 46 | 41 | 46 |
| D– 30/29 −4 =26/25 | | D– | 26/25 | 26/25 | 26/25 | 26/25 |
| O– 43+4 =47 | TEAM 2 | O– | 47 | 52 | 47 | 47 |
| D– 54/53 +4 =58/57 | | D– | 58/57 | 53/52 | 58/57 | 58/57 |

210

FUMBLE:

| | | (FN) |
|---|---|---|
| TEAM 1 | O– | 56 |
| | D– | 46 |
| TEAM2 | O– | 44 |
| | D– | 53 |

USE:

| FOR OFFENSE: | (FRN) | (TOTALS) | (RANGE) |
|---|---|---|---|
| TEAM 1 | 11–38 | 1–56 | 11–48 |
| | | OPP– 57–109 | 51–86 |
| TEAM 2 | 11–47 | 1–44 | 11–45 |
| | | OPP– 45–90 | 46–84 |

PENALTY:

| | (PN) |
|---|---|
| TEAM 1 | 49 |
| TEAM 2 | 53 |

USE:

| | (TOTALS) | (RANGE) |
|---|---|---|
| TEAM 1 | 1–49 | 11–44 |
| TEAM 2 | 50–102 | 45–82 |

SACK:

| | (RANGE) |
|---|---|
| TEAM 1 | 11–72 |
| TEAM2 | ALL (QR=SACK IF 11–18) |

INT:

| | (RANGE) |
|---|---|
| TEAM 1 | 11–45 |
| TEAM2 | ALL |

WEATHER FOOTNOTES:

220

FIG. 15

230

WEATHER CONDITIONS CHART

| DICE ROLL | A | | B | | C | | D | DICE ROLL |
|---|---|---|---|---|---|---|---|---|
| | 1 | 2 | 1 | 2 | 1 | 2 | ALL | |
| 12 | 1 & 7 | NA | NA | NA | NA | NA | NA | 12 |
| 44 | NA | 5 | NA | NA | 1 & 7 | NA | NA | 44 |
| 88 | 1 | NA | NA | NA | NA | NA | NA | 88 |

| | | KICKING TEAM | | |
|---|---|---|---|---|
| | | A | B | C |
| RETURN TEAM | A | B | A | A |
| | B | C | B | A |
| | C | C | C | B |

*Locate the kicking teams grade along the top of the chart. Then locate the opponent's return team grade along the left side of the chart. Follow down the chart (for the kicking team) and across the chart (for the return team) until columns cross to determine the grade to be used for the return. (Example - The kicking team has a grade of "B"; the return team has a grade of "C". The grade used for the play would be "C".)*

FIGURE 17

| INTERCEPTION TABLE | | | | |
|---|---|---|---|---|
| | INT 1 | INT 2 | INT 3 | INT 4 |
| 11- | -6 | 9 | 20 | 36 |
| ^^^

| LONG PLAY TABLE | | | | | |
|---|---|---|---|---|---|
| LR-1 | LR-2 | LR-3 | LR-4 | LR-5 | LR-6 |
| 2- 92 | | | | | 2- 23 OB |
| 3- 87 | | | | | 3- 15 |
| 4- 68 | | | | | 4- 19 |
| 5- 78 | | | | | 5- 78 |
| 6- 74 OB | | | | | 6- 10 |
| 7- 81 | | | | | 7- 8 |
| 8- 47 | | 8- 33 OB | | | 8- 9 |
| 9- 63 OB | | 9- 31 | | | 9- 7 OB |
| 10- 51 | | 10- 35 | | | 10- 8 |
| 11- 54 | | | | | 11- 6 OB |
| 12- 64 OB | | | | | 12- 12 |
| 13- 73 | | | | | 13- 14 |
| 14- 66 | | | | | 14- 16 OB |
| 15- 72 OB | | | | | 15- 18 |
| 16- 99 | | | | | 16- 25 |

FIGURE 20

| | FC 1 | FC 2 | FC 3 | FC 4 | FC 5 | FC 6 | FC 7 | FC 8 | FC 9 | FC 10 |
|---|---|---|---|---|---|---|---|---|---|---|
| -27 | | 12 | -4 | 19 | | | | | | |
| -28 | | -3 | 5 | 4 | | | | | | |
| -31 | | -5 | -3 | 0 | | | | | | |

FIGURE 21

| PENALTY CHART | | | | | |
|---|---|---|---|---|---|
| RUNNING PLAYS | | PASSING PLAYS | | PLACE KICKS | |
| Offense | Defense | Offense | Defense | Offense | Defense |
| 4- 6<br>5- 36<br>6- 14 | 4-23<br>5- 31<br>6- 35 | | | | |
| KICKOFFS | | PUNTS | | RETURNS | |
| Return Team (RT) | Kicking Team (KT) | Kicking Team (KT) | Return Team (RT) | Offense | Defense |
| | | | | | |

FIGURE 22

OFFENSIVE PENALTIES

DEFENSIVE PENALTIES

29 - Twisting the Face Mask - 15 from gain and first down

31 - Unnecessary Roughness - 15 from line

33 - Unsportsmanlike Conduct - 15 from line

FIGURE 23

| INJURY DURATION TABLE | | | | | | | |
|---|---|---|---|---|---|---|---|
| | INJ-5 | INJ-4 | INJ-3 | INJ-2 | INJ-1 | INJ-0 | |
| 7- | 55 PLAYS(+) | 48 PLAYS(+) | | | | | -7 |
| 8- | 60 PLAYS | 29 PLAYS | | | | | -8 |
| 9- | -1 | 1 GAME | | | | | -9 |

FIGURE 24

| | |
|---|---|
| 5 | Returner runs for a touchdown. Flag on play during return. See Penalty Chart-Returns for results. |
| 6 | Returner carries ball 10 yards and fumbles. Ball rolls 6 additional yards downfield and then goes out of bounds. |
| 7 | Returner fumbles after 9 yard return where one of his teammates illegally bats ball out of bounds. 10 yard penalty against return team from spot of foul. Return team retains possession. |

FIGURE 25

WEATHER CHART FOOTNOTES

1 - *Light rainfall during the game. Subtract 3 Offensive Rating points from both teams for ALL LONG PASS PLAYS. Subtract 1 Offensive Rating point from both teams for all other types of passing plays. No FIELD GOAL may be attempted from 57 yards or further.*

--

7 - *Strong winds during the game. Use board result number 2 numbers lower for ALL LONG PASS PLAYS. Use play results indicated with (*) for ALL PLACE KICKS, PUNTS AND SAFETY KICKS ONLY when they appear.*

FIGURE 28

TEAM 1

Playing Field/Weather: N/A
Home Field Advantage: +3
Visitor Disadvantage: -4
Quarter Adjustments:

| | 1 | 2 | 3 | 4 |
|---|---|---|---|---|
| Offense - | -5 | +5 | 0 | +5 |
| Defense - | 0 | 0 | 0 | 0 |

Fumble Number: Offense 56 Defense 46
Fumble Range (FRN): 11-38
Penalty Number: 49
Team Sacks: 11-72
Team Interceptions: 11-45
Special Teams:
Kickoff: B Kickoff Return: B Punt: C Punt Return: C

TEAM 2

Playing Field/Weather: N/A
Home Field Advantage: +4
Visitor Disadvantage: 0
Quarter Adjustments:

| | 1 | 2 | 3 | 4 |
|---|---|---|---|---|
| Offense - | 0 | +5 | 0 | 0 |
| Defense - | 0 | -5 | 0 | 0 |

Fumble Number: Offense 44 Defense 53
Fumble Range (FRN): 11-47
Penalty Number: 53
Team Sacks: ALL QR = Sack if 11-18
Team Interceptions: ALL
Special Teams:
Kickoff: A Kickoff Return: C Punt: A Punt Return: A

FIGURE 26

TIMING CONVERSION CHART (A)

| PLAYS | | TIME | PLAYS | | TIME | PLAYS | | TIME |
|---|---|---|---|---|---|---|---|---|
| ½ | - | :15 | 10½ | - | 5:15 | 20½ | - | 10:15 |
| 1 | - | :30 | 11 | - | 5:30 | 21 | - | 10:30 |
| 1½ | - | :45 | 11½ | - | 5:45 | 21½ | - | 10:45 |
| ^^^

TIMING CONVERSION CHART (B)

| DICE ROLL | ADD (SEC) | DICE ROLL | ADD (SEC) | DICE ROLL | ADD (SEC) | DICE ROLL | ADD (SEC) |
|---|---|---|---|---|---|---|---|
| 11 | 0 | 31 | 4 | 51 | 8 | 71 | 12 |
| 12 | 0 | 32 | 4 | 52 | 8 | 72 | 12 |
| 13 | 0 | 33 | 4 | 53 | 8 | 73 | 12 |
| ^^^

TIMING CONVERSION CHART (C)

| PLAYS | TIME | PLAYS | TIME | PLAYS | TIME |
|---|---|---|---|---|---|
| 24 | 12:00 | | | | |
| | | 26 3/4 - | 13:22 | | |
| | | | | 30 - | 15:00 |

^^^

FOOTBALL BOARD GAME

BACKGROUND OF THE INVENTION

This invention relates generally to amusement devices. More particularly, the present invention relates to a game board apparatus for simulating the playing of football.

The game of football is one of the most popular games in the United States and many people enjoy watching the game. Heretofore, numerous board games have been provided in order to simulate the game of football. Generally, such games are merely games of chance with both contestants having an equal opportunity to win. Skill and strategy play no particular part in the outcome of such games. Almost all of these games include generally a simulated football field having various yardage markers thereon and including a movable piece to indicate the position of the ball on the playing field.

The difficult aspect of a football game, however, is to provide some means to allow a player to use strategy similar to the strategy used in the actual game of football and for that strategy to yield similar results. Many of the prior art football games attempt to introduce strategy into the game, but the means to provide the strategy require such a great variety of spinners, cards, playing pieces and the like, so that the players must concentrate on the apparatus to the detriment of the strategic planning that should be the essence of the game.

Accordingly, it has been considered desirable to develop a new and improved football board game which would overcome the foregoing difficulties and others while providing better and more advantageous overall results.

BRIEF SUMMARY OF THE INVENTION

In accordance with the present invention, a simulated football game apparatus is provided.

More particularly in accordance with this aspect of the invention, the apparatus comprises a game board on which is depicted a standard football playing field, the game board also having a plurality of indicia outside the playing field and a game piece movable on the game board to indicate the position of the football on the playing field. A first set of playing cards is provided with each card representing an offensive player and each card including a group of numbers. A second set of playing cards is provided with each card representing a defensive player and each card including a group of numbers. A chance number selector means is operable on each play to produce a first number corresponding to one of the numbers on the group of numbers on the cards. A team tendencies booklet is provided for indicating the relative strengths of an offense and a defense of a first team in relation to an offense and a defense of a second team of the two teams facing each other. A plurality of first charts is provided with each of these charts being divided into a plurality of indicia bearing sections including a group of numbers for a particular play, such as a pass play attempted at a particular section of the field at which the game piece is positioned. The result of the given play is determined by the first number produced by the selector means. The first number corresponds to a second number which is one of the group of numbers on the playing card. The second number in turn corresponds to a third number which is one of the group of numbers on one of the first charts to secure the result of the play. Various columns of such third numbers are listed on the plurality of first charts.

In accordance with another aspect of this invention, a football board game is provided.

More particularly in accordance with this aspect of the invention, the game comprises a game board on which is depicted a standard football playing field and a game piece that is movable to indicate the position of the football on the playing field. A first set of playing cards is provided, each representing an offensive skill player on a football team with each card bearing at least one set of indicia for run, pass or kick plays. A group of numbers is located on the cards opposite each set of indicia. A chance number selector means is operable on each play to produce a first number corresponding to one number of the group of numbers on the cards. A team roster is provided for each of the two teams which are facing each other during the game. A rating point is provided for each player on the roster indicating playing ability. The total rating points for the starters on each roster are used to indicate the total offensive and defensive power of each of the two teams. A plurality of first charts is provided, each of which is divided into a plurality of indicia bearing sections including a group of numbers for a particular play, such as a pass play attempted at a particular section of the field at which the game piece is positioned. The result of the given play is determined by the first number produced by the selector means with the first number corresponding to a second number which is one of the group of numbers on the playing card. The second number in turn corresponds to a third number which is one of the group of numbers on one of the first charts to secure the result of a play. Various columns of such third numbers are listed on the plurality of first charts. A column to be used for a particular game is determined by the total offensive and defensive rating points of the eleven participating offensive and defensive players on the field.

In accordance with still another aspect of the invention, a simulated football game apparatus is provided.

More particularly in accordance with this aspect of the invention, the apparatus comprises a game board on which is depicted a standard football playing field, the game board also including weather condition indicia located outside the playing field. A game piece is movable on the game board to indicate the position of the football on the playing field. A first set of playing cards is provided, each card representing an offensive skill player on a football team and each card also including a group of numbers. Chance number selector means is operable on each play to produce a first number corresponding to one number of the group of numbers on the cards. A plurality of first charts is provided, each of which is divided into a plurality of indicia bearing sections including a group of numbers for a particular play, such as a pass play attempted at a particular section of the field at which the game piece is positioned. The result of a given play is determined by the first number produced by the selector means, the first number corresponding to a second number which is one of the group of numbers on the playing card. The second number in turn corresponding to a third number which is one of the group of numbers on one of the first charts to secure the result of a play.

One advantage of the present invention is the provision of a new and improved football game that can be played either as a board game or as a computerized game on a monitor.

Another advantage of the present invention is the provision of a game in which a football contest between two real teams can be realistically reproduced such that the offensive and defensive capabilities of the opposing teams and the playing abilities of individual players are accurately portrayed.

Still another advantage of the present invention is the provision of a game in which the selected 11 men in the line-up of a given team are related to present day teams and real-life players, the teams being able to perform in the simulated game correspondingly to their ability to perform in real-life. The capabilities of each team are revised each year depending on their actual performance in the previous year.

Yet another advantage of the present invention is the provision of a football game in which the actual weather conditions at given stadiums can be realistically portrayed.

Yet still another advantage of the present invention is the provision of a football game which has a ball control option and a fumble prevention option as well as a three minute drill at the end of each half of the game.

A further advantage of the present invention is the provision of a football game which takes into account the uncertainties of fumbles, penalties, blooper plays, sacks and interceptions such as regularly occur in football games.

A still further advantage of the present invention is the provision of a football game in which the time of the game fairly accurately portrays the time that a real football game takes.

A yet further advantage of the present invention is the provision of a football game in which the tendencies of various real teams can be accurately simulated together with home field advantage and visiting team disadvantage by quarters of the football game.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof, and wherein:

FIG. 4 is a plan view of a score sheet utilized with the preferred embodiment of the present invention;

FIG. 8 is a plan view of a series of charts used in the game to determine short pass plays;

FIG. 9 is a plan view of a series of charts used in the game to determine medium pass plays;

FIG. 10 is a plan view of a series of charts used in the game to determine long pass plays and screen passes;

FIG. 11 is a plan view of a series of charts used in the game to determine a three minute drill;

FIG. 12 is a plan view of a series of miscellaneous charts used in the game;

FIGS. 14A and 14B are a plan view of a score chart used in an advanced game according to an alternate embodiment of the present invention;

FIG. 15 is a plan view of a weather conditions chart utilized in the advanced game;

FIG. 17 is a plan view of a kickoff, kick return, punt and punt return grade chart according to the present invention;

FIG. 18 is a plan view of a portion of an interception table according to the present invention;

FIG. 19 is a plan view of a portion of a long play-pass table according to the present invention;

FIG. 20 is a plan view of a portion of a long play-run table according to the present invention;

FIG. 21 is a plan view of a portion of a fumble and blocked kick chart according to the present invention;

FIG. 22 is a plan view of a portion of a numerical penalty chart according to the present invention;

FIG. 23 is a plan view of a portion of an offensive and defensive penalties descriptive list according to the present invention;

FIG. 24 is a plan view of a portion of an injury duration table according to the present invention;

FIG. 25 is a plan view of a portion of a blooper play instructions and result chart according to the present invention;

FIG. 26 is a plan view of a portion of the team tendency booklet of FIG. 16 illustrating the team tendencies of the Houston Oilers and Seattle Seahawks;

FIGS. 27A, 27B and 27C are plan views of three timing conversion charts according to the present invention; and, FIG. 28 is a plan view of a portion of a weather chart footnotes list according to the present invention.

DETAILED DESCRIPTION OF PREFERRED AND ALTERNATE EMBODIMENTS

Figure 1:
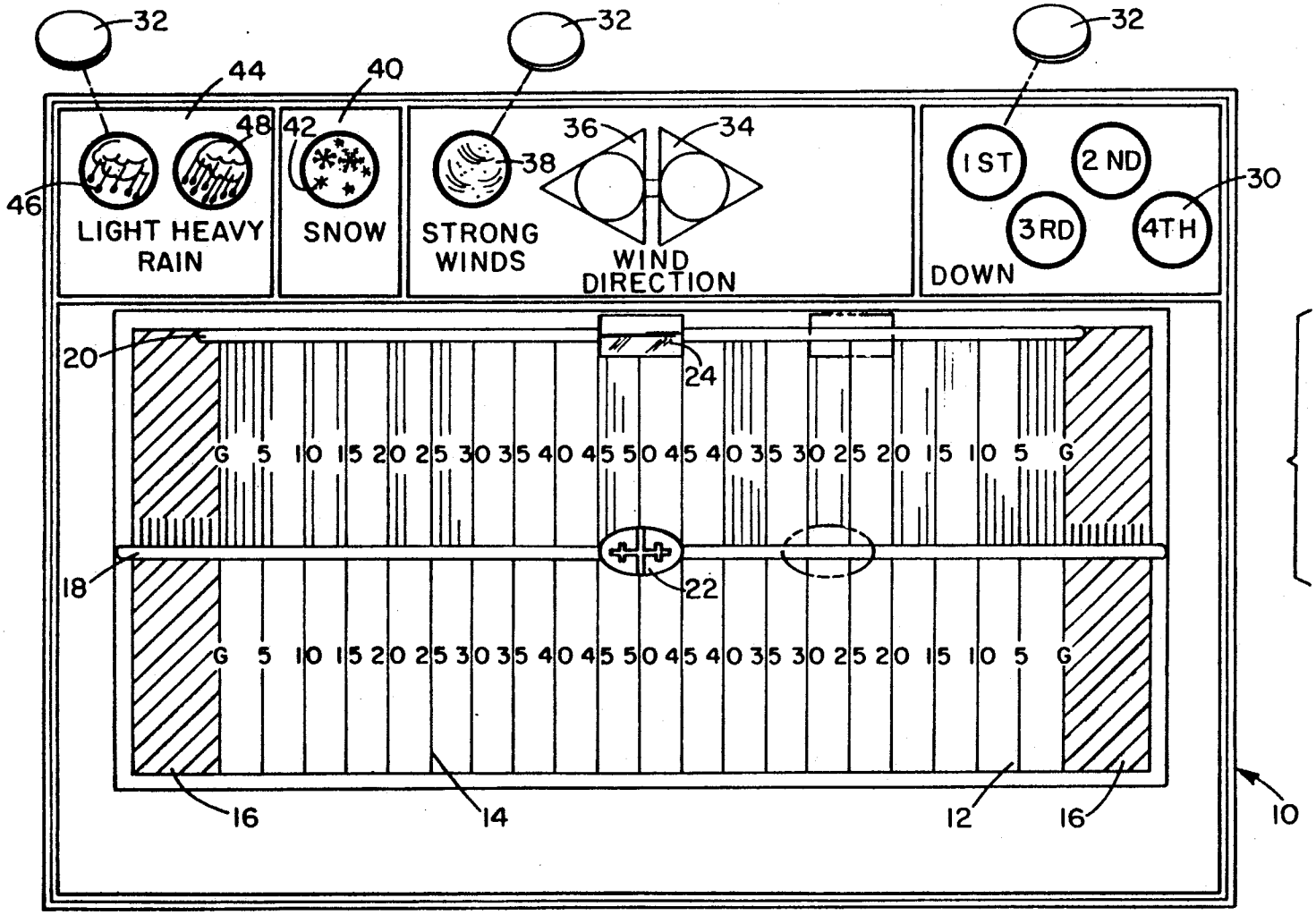
FIG. 1 is a top plan view of the game board on which is depicted a playing field having thereon a pair of movable game pieces representing a yard marker and a football, as well as several indicia outside the playing field.

Referring now to the drawings, wherein the showings are for purposes of illustrating preferred and alternate embodiments of the invention only and not for purposes of limiting same, FIG. 1 shows the subject new football game as a board game. While the game is shown as being played manually on a board using a plurality of charts, cards and dice to determine results, it should be appreciated that the game could also be adapted for play on a computer through the use of a software program and a video monitor.

A game board 10 has a football field 12 depicted thereon. The field is divided into five yard sections 14 as on an actual field and end zones 16 are provided at each end of the field. The game board is also provided with a first longitudinal groove 18 extending down the center of the field and a second longitudinal groove 20 extending down one sideline of the field. Slidable along the first groove 18 is a game piece 22 simulating a football. A sideline marker 24 is slidable along the second groove 20. The football 22 and sideline marker 24 each have downwardly projecting lugs (not visible) which fit into the respective grooves 18 and 20 so that the game pieces may be guided as they are moved. The sideline marker 24 has a length equivalent to a 10 yard distance on the game board.

In the upper right hand corner of the game board 10 are four circles 30 which are denoted respectively as first, second, third and fourth with the legend "down" being printed below the circles. Through the use of a token 32 contestants in the game can keep track of the downs.

In the upper center portion of the game board 10 is located a wind direction indicium including a pair of oppositely facing triangles 34, 36. This section of the game board is used in the advanced game if wind plays a factor in the game. The token 32 can be positioned in one of the triangles to indicate wind direction if that plays a part in the game. Located adjacent the wind direction triangles 34 and 36 is a strong winds indicium area 38. A suitable token 32 can similarly be placed in this area to indicate that strong winds are prevalent during the playing of the game.

Located on the upper left hand corner of the game board 10 is a second weather indicium area for rain or snow. More particularly, a snow block 40 is provided with an indicium 42 and a rain block 44 is provided with a light rain indicium 46 and a heavy rain indicium 48. A suitable marker or token 32 can be placed in one of these circles to indicate precipitation during the game.

Figure 2:
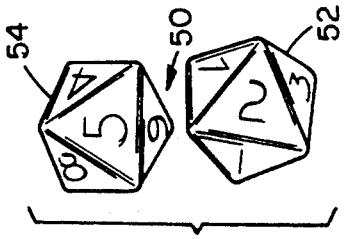
FIG. 2 is a top plan view of the chance number selector means employed in the game.

In order to achieve movement of the football game piece on the field 12, a chance selector means is provided. With reference now to FIG. 2, the chance selector means preferably comprises a pair of dice 50. Preferably the dice are each eight-sided die 52 and 54 respectively, with the dice being of different colors, for example, black and red. When the dice are rolled in playing the game, the numbers turned up are normally combined, not added, with the number on the first colored die, preferably black, being used as the first digit of the combined number. As a result, any number from 11 to 18, 21 to 28 etc. to 88 can be rolled. It should be recognized, however, that other indicia can be provided for distinguishing between the dice, for example, one die could be larger than the other die in order to recognize and identify that die and to provide the first digit of the combined number resulting from a roll. Also other types of chance number selector means than dice can be used. For example, if the game is computerized, a random number generator program can be provided in the software of the game.

Figure 3:
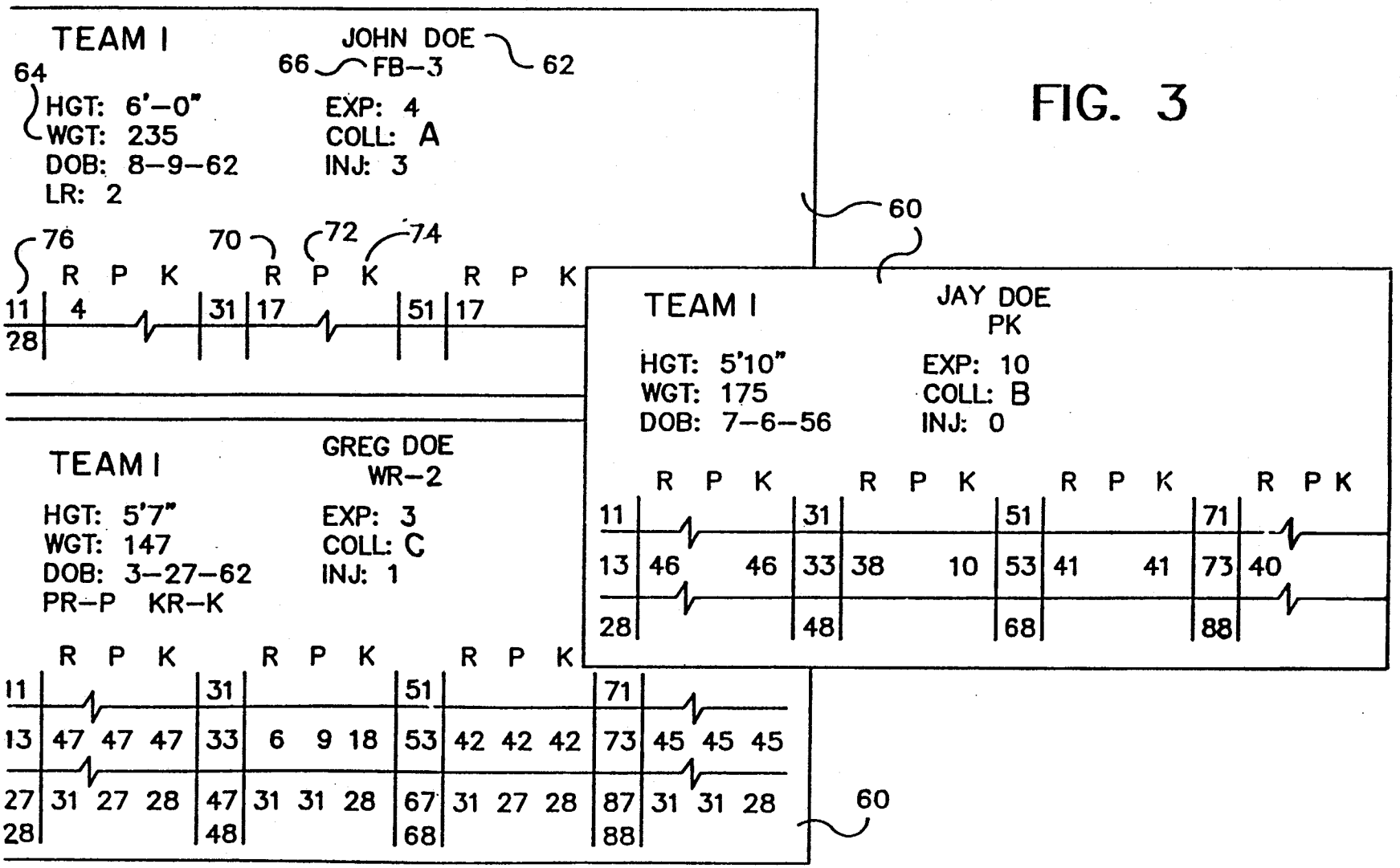
FIG. 3 is a top plan view of several playing cards of the type provided to represent each player on each team.

Each of the contestants playing the game is provided with a set of playing cards, a first set of cards representing one team and a second set of cards representing the other team. Each set of cards contains preferably about thirty cards with each card representing a player on the team. Three sample playing cards are illustrated in FIG. 3. Each card 60 bears a player's name 62 and other personal information 64 and the position he plays on offense or defense 66. From the personal information section 64, it can be ascertained that the player Greg Jones, in addition to being a wide receiver as shown in block 66, also runs back punts and returns kicks. Beneath the heading of the card are three sections 70, 72 and 74 labeled "R", "P" and "K" respectively. These initials stand for "run", "pass" and "kick". Beneath each of these letters is a column with a plurality of numbers and adjacent a left-hand side of the three columns is a set of index numbers 76 beginning with 11 and terminating with 88. These numbers are all the numerical variations capable of being rolled with the dice 50 illustrated in FIG. 2. Thus a dice roll of 27 will translate to an "R" numeral of "31", a "P" numeral of "27" and a "K" numeral of "28" for this player. These latter numbers then have to be correlated with a second set of numbers provided on one of a set of offensive playing charts illustrated in FIGS. 5–10.

Figure 5:
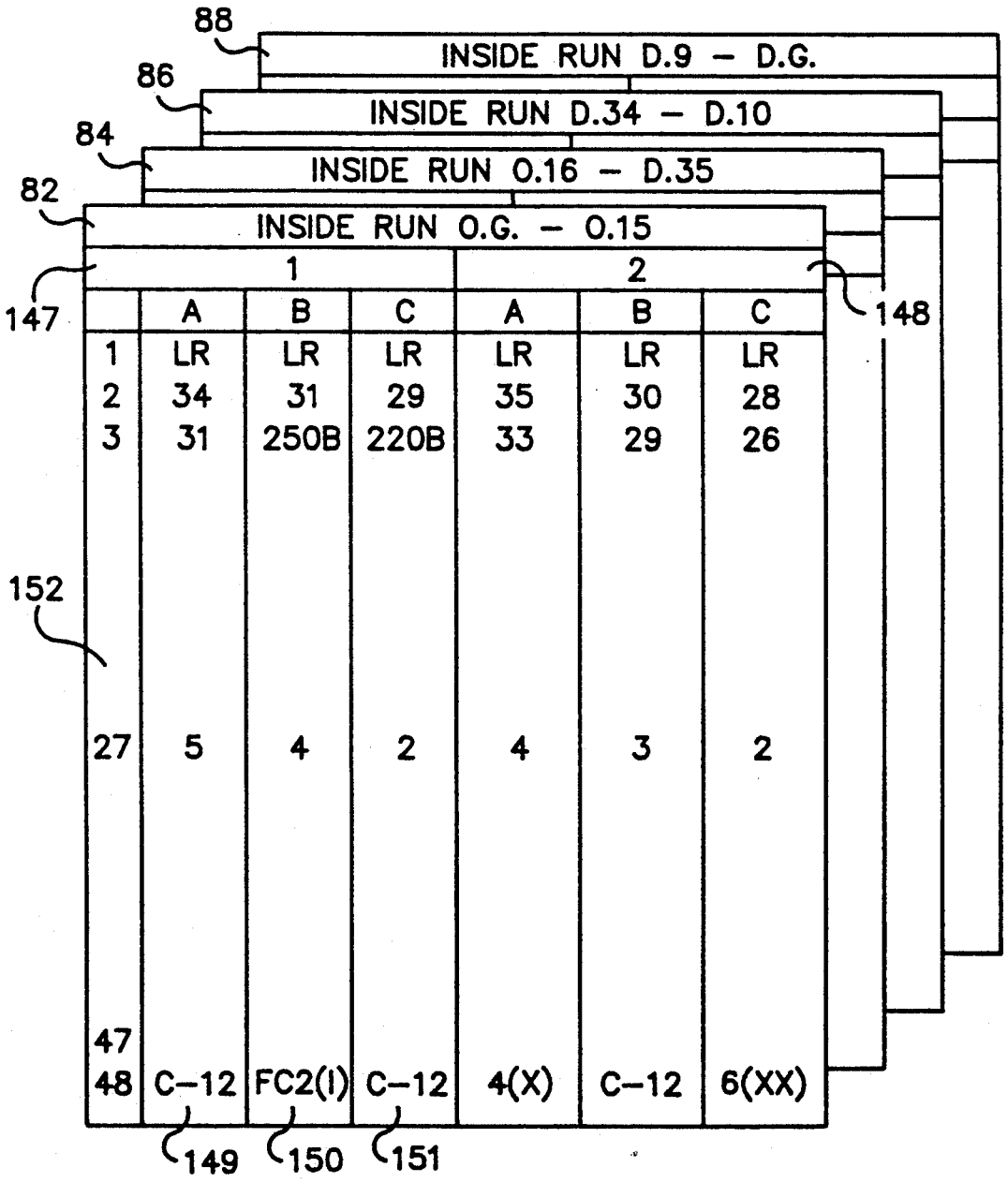
FIG. 5 shows a plan view of series of charts used in the game to determine inside running plays.
Figure 6:
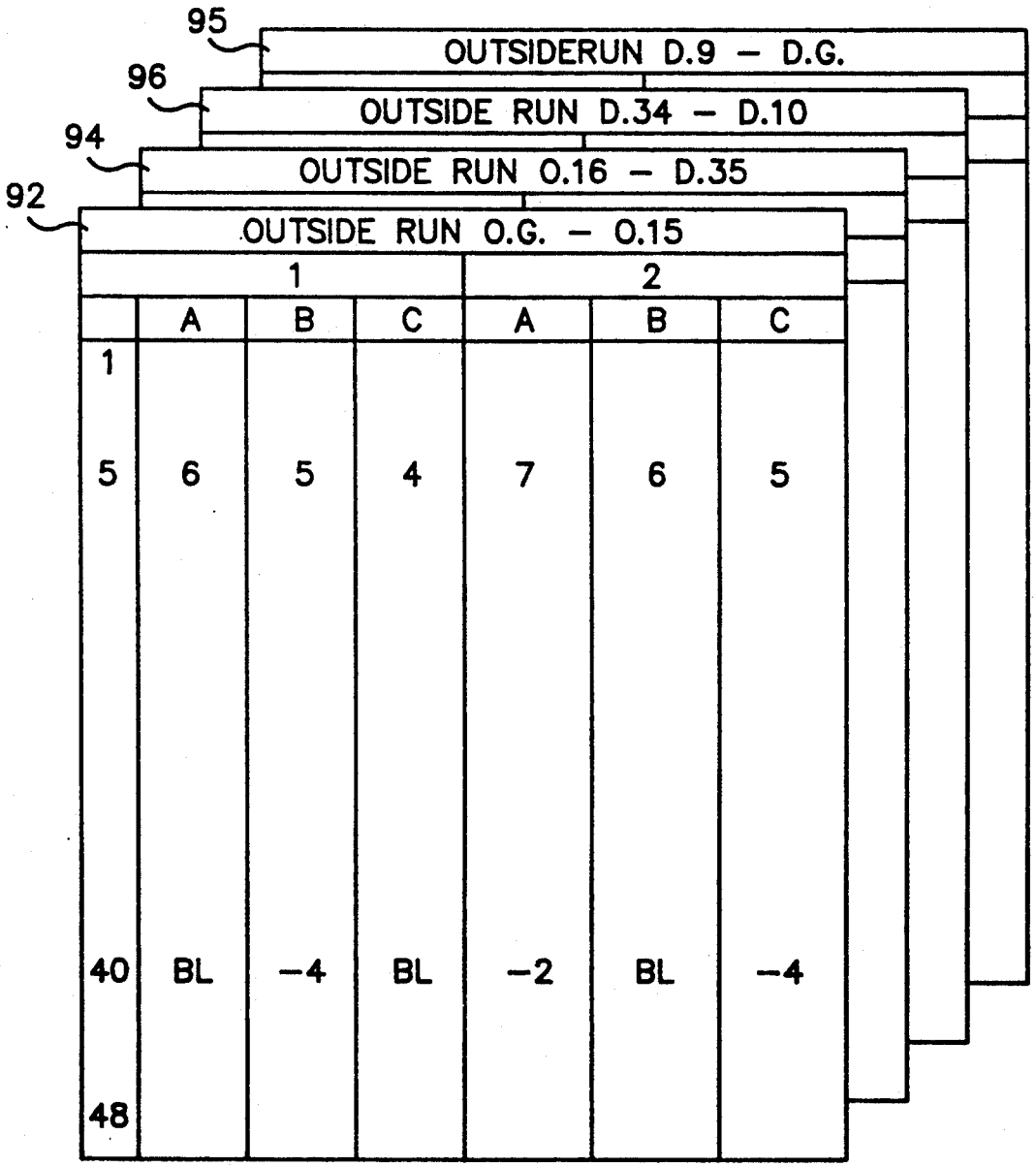
FIG. 6 is a plan view of a series of charts used in the game to determine outside running plays.

Briefly, FIG. 5 illustrates a set of inside run charts, namely inside runs from the offensive goal to the offensive 15 yard line shown in chart 82, inside runs from the offensive 16 yard line to the defensive 35 yard line shown in chart 84 inside runs from the defensive 34 yard line to the defensive 10 yard line shown in chart 86 and inside runs from the defensive 9 yard line to the defensive goal shown in chart 88. Similarly, outside runs are illustrated in FIG. 6 by several charts. There are preferably four charts 92, 94, 96 and 98 for utilization with outside runs from the offensive goal to the offensive 15 yard line, offensive 16 yard line to the defensive 35 yard line, defensive 34 yard line to the defensive 10 yard line and defensive 9 yard line to the defensive goal.

Figure 7:
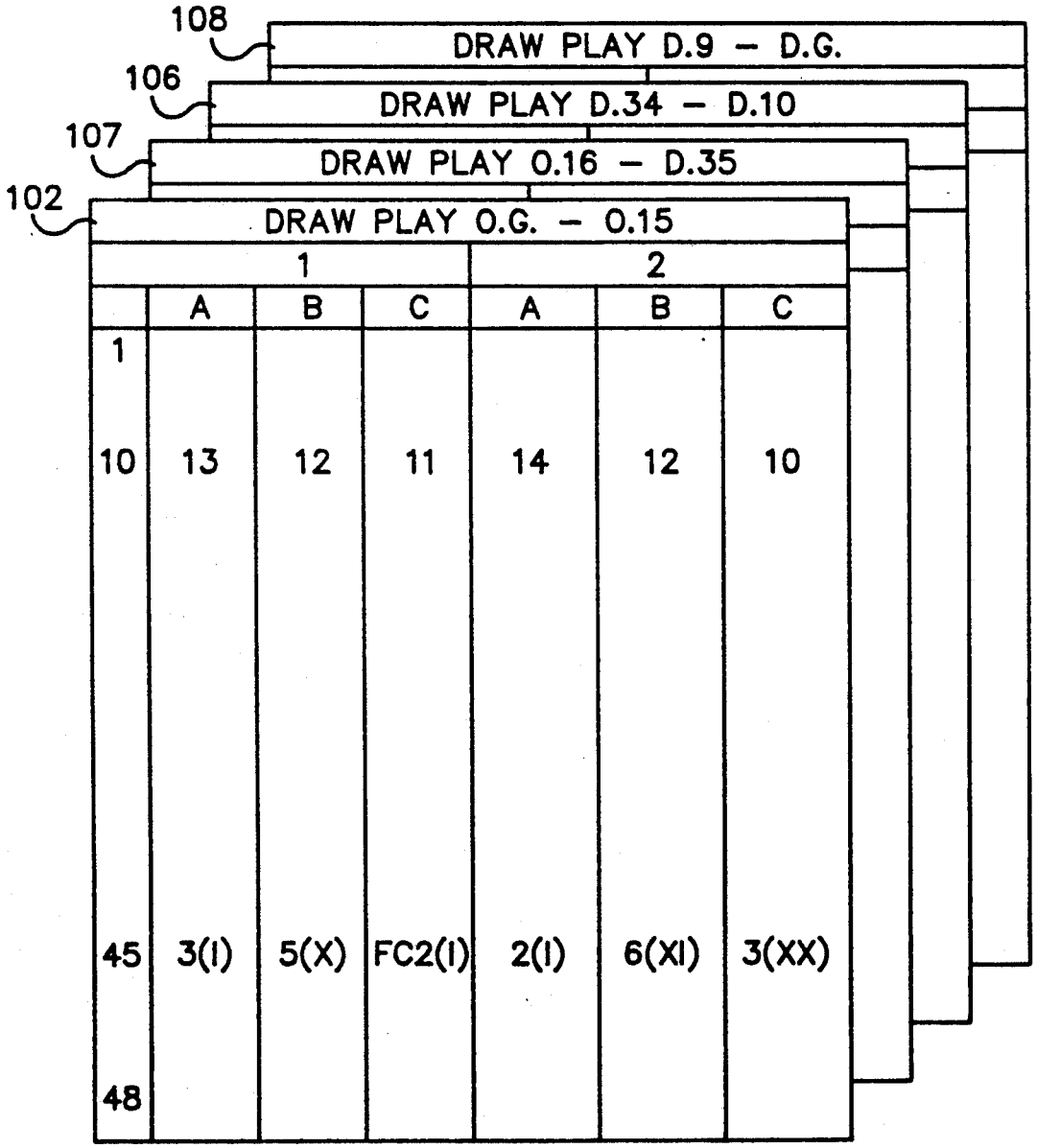
FIG. 7 is a plan view of a series of charts used in the game to determine draw plays.

FIG. 7 illustrates the use of a series of four draw play charts 102, 104, 106 and 108 for utilization with a draw play attempted at various sections of the field, much along the lines of FIGS. 5 and 6.

A first set of play charts utilized with the short pass is illustrated in FIG. 8. Four such charts are illustrated at 112, 114, 116 and 118. These charts are utilized, respectively, for short pass plays attempted from the offensive goal to the offensive 20 yard line, the offensive 21 yard line to the defensive 35 yard line, the defensive 34 yard line to the defensive 10 yard line and the defensive 9 yard line to defensive goal. Medium passes are illustrated in FIG. 9. Four such charts 122, 124, 126 and 128 are provided. These charts are utilized, respectively, for medium pass plays from the offensive goal to the offensive 20 yard line, the offensive 21 yard line to mid-field, the defensive 49 yard line to the defensive 30 yard line and the defensive 29 yard line to the defensive 13 yard line.

Long pass play charts are illustrated in FIG. 10. Three such charts 132, 134 and 136 are provided. These charts are utilized, respectively, on long pass plays from the offensive goal to the offensive 20 yard line, the offensive 21 yard line to mid-field and from the defensive 49 yard line to the defensive 30 yard line. FIG. 10 also illustrates the use of a screen pass play chart 140 which is utilized for pass plays from the offensive 21 yard line to the defensive 35 yard line.

With reference now to FIG. 12, a number of miscellaneous charts is there shown. These include an indicator chart 141, an interception table 142, an intercepted pass return table 143, and a fumble recovery and blocked kick return table 144. Also disclosed in FIG. 12 are a pair of fumble and blocked kick return charts 145 and a penalty chart 146. Of these, the indicator chart 141, interception table 142, and fumble and blocked kick charts 145 utilize the dice numbers from 11–88. In contrast, the intercepted pass return chart 143 and fumble recovery blocked kick return charts 145 utilizes a set of numbers 1–48. The penalty chart 146 uses numbers 2–16.

With reference now, again, to FIG. 5, sheet 82, as are all the other charts, is divided into two halves 147 and 148, for the halves of the game, and into three letters A, B and C. The letters indicate the relative strength of the offense of a first team in relation to the defense of a second team. Below each of these letters is an alphanumeric column 149, 150 and 151. Positioned adjacent the leftmost column on the chart 82 is a column 152 which identifies the various numerical combinations which are listed on the player cards 60 adjacent the column 76 showing the various numbers capable of being rolled with the pair of eight-sided dice 50. These numerical combinations range from 1 through 48 which are all the numerical combinations utilized under the "R", "P" and "K" columns in any of the player cards 60. The manner of determining the particular column and sub-column to be used in securing the result of a play will be shown in describing the playing of the game.

Each column of each section bears indicia setting forth the results of plays. For example, in the first half of the game, and with a relative strength of offense against defense in the B column, the row at numeral 3 (25 OB) would indicate that a twenty five yard inside run was achieved and that the runner went out of bounds. In contrast, the numeral 27 would indicate a four yard advance, and the numeral 48 would indicate that a fumble had occurred and one would need to refer to the fumble and blocked kick chart 145 under FC 2. Also, an injury has occurred, as designated by "I". It is evident that symbols are employed instead of numbers to indicate other possible results of a play such as a fumble (FC), an injury (I), a penalty (X) or a touchdown (TD). These various outcomes will be addressed when the rules of the game are discussed.

With reference now also to FIG. 4, a basic score sheet 160 is there illustrated for playing the basic version of the game. Each contestant takes his set of playing cards 60 which represent the team he will control. Strictly for purposes of illustration, we will consider the game as being played between Houston and Seattle with Houston being the visiting team. After the line-ups have been selected, offensive and defensive rankings are established by adding the rating points of all 11 starting players on each of the four platoons, i.e., Houston's offense and defense and Seattle's offense and defense. The sum of the totals is printed in each of the appropriate boxes on the upper left area 162 of the score sheet 160. The team rosters for Houston and Seattle, as well as the individual lists for Seattle (giving the likelihood of a particular player making a selected play) are shown below:

| Offense | | Defense | |
|---|---|---|---|
| | Seattle Seahawks Roster | | |
| LWR - | Blades (7), Largent (3) | LE - | Green (3), Mitz (2) |
| LT - | Mattes (2), Heck (3) | NT - | Nash (3-4), Hart (2-3) |
| LG - | Bailey (2) | RE - | Bryant (2-3) |
| C - | Feasel (2) | LOLB - | Porter (3-5), Woods (2-3) |
| RG - | Millard (3) | LILB - | Comeaux (4) |
| RT - | Wilson (3) | RILB - | Wyman (3-2) |
| TE - | Tyler (2) | ROLB - | Maxwell (3), M. L. Johnson (2) |
| RWR - | Clark (2), Skansi (2) | LCB - | Harper (3), Jenkins (2) |
| QB - | Krieg (3), Stouffer (2) | RCB - | Hunter (3), Jefferson (2) |
| RB - | Warner (3), Harris (2) | SS - | Glasgow (4), Hollis (2) |
| FB - | J. Williams (4) | FS - | Robinson (4) |
| PK - | N. Johnson | | |
| P - | Rodriguez | | |
| | Houston Oilers Roster | | |

-continued

| | | | |
|---|---|---|---|
| LWR - | Hill (6), Jeffries (5), Harris (2) | LE - | Childress (5, NT-3), Fuller (2-4) |
| LT - | B. Davis (5) | NT - | D. Smith (3-2), Byrd (3, DE-2) |
| LG - | Munchak (6) | RE - | S. Jones (2-4) |
| C - | Pennison (3), Maggs (3, G-2, T-2) | LOLB - | Lyles (3) |
| RG - | Matthews (6, T-4, C-3) | LILB - | Grimsley (3) |
| RT - | Steinkuhler (5, G-4) | RILB - | A. Smith (3), Fairs (2-3) |
| TE - | Mrosko (3) | ROLB - | Meads (3) |
| RWR - | Givins (5), Duncan (4) | LCB - | Brown (3) |
| QB - | Moon (6), Carlson (3) | RCB - | Allen (3) |
| RB - | Pinkett (4), Rozier (4) | SS - | McDowell (4), K. Johnson (2) |
| FB - | Highsmith (4), White (3) | FS - | Donaldson (3), Eaton (3) |
| PK - | T. Zendejas | | |
| P - | Montgomery | | |

Seattle Individual Lists

| Receiver's Grades | Long Pass | Medium (+3 minute) |
|---|---|---|
| Blades - A | Clark 11-18 | Clark 11-18 |
| Largent - B | Largent 21-38 | Largent 21-38 |
| Warner - B | Blades 41-78 | Blades 41-68 |
| Clark - C | Skansi 81-84 | Skansi 71-78 |
| Skansi - C | Tyler 85-88 | Tyler 81-85 |
| Tyler - C | | Warner 86-88 |
| Harris - C | | |
| Williams - C | | |

| Short | Screen | Kickoff Return |
|---|---|---|
| Warner 11-16 | Warner 11-38 | Warner 11-54 |
| Clark 17-18 | Williams 41-68 | Harris 55-86 |
| Largent 21-48 | Harris 71-76 | Clark 87-88 |
| Harris 51-58 | Skansi 77-78 | |
| Blades 61-68 | Clark 81-84 | |
| Skansi 71-75 | Tyler 85-88 | |
| Tyler 76-84 | | |
| Williams 85-88 | | |

| Punt Returns | Sacks | Interceptions |
|---|---|---|
| Clark 11-86 | Porter 11-25 | Glasgow 11-28 |
| Harris 87-88 | Comeaux 26-38 | Hunter 31-38 |
| | Green 41-48 | Harper 41-58 |
| | Hart 51-58 | Jenkins 61-66 |
| | Nash 61-67 | Jefferson 67-75 |
| | Glasgow 68-75 | Porter 75-81 |
| | Hunter 76-83 | Comeaux 82-88 |
| | Harper 84-88 | |

In the sample score sheet Houston's offense equals a 45, while their defense equals 30 for running and 29 for passing. In contrast, Seattle's offense equals 43, while their defense equals 54 for runs and 53 for passes. Next the offensive grade for each team is computed. If the offensive total is 14 or more points greater than the defensive total then the "A" offense column is used for that game. If the offensive total is 13 points above to 13 points below the defensive total the "B" column is used for offense for that game. If the offensive total is 14 or more points below the defensive total then the "C" offensive column is used for that game.

On some occasions, the offensive grade is not the same for running and passing plays. This is illustrated in the Houston/Seattle example in that the total offensive rating point for Seattle is a "B" for running plays but is an "A" for passing plays, being that 43 is 14 points above Houston's pass defense of 29.

Next, the special teams area 164 of the chart needs to be filled out. Each team's kickoff, kick return, punt and punt return grades are placed in the appropriate boxes in the score sheet. The grades for kickoff and punt returns for each team are determined by using a kickoff and punt return grade chart illustrated in FIG. 17.

In the basic game, the fumble section 166, penalty section 168, sack section 170 and interception section 172 is always the same for any two teams. In this regard, the fumble section will be 11–48 for the visiting team and 51–88 for the home team, as will the penalty section. In contrast, the sack and interception sections will always be 11–68 for the visiting team and 71–88 for the home team. This changes in the advanced version of the game described hereinbelow.

A separate block 174 is provided to keep track of the team's total time outs. Each team is allowed three time outs per half and two in each overtime period. The timing of the game is such that each quarter consists of thirty plays. Such plays are kept track of in the plays section of block 174. Certain plays, however, may require multiple dice rolls such as the previously mentioned fumbles, penalties, sacks and interceptions. Also, several plays do not count in the timing of a game. Extra points, touchbacks and out-of-bounds on kickoffs or on-side kickoffs that have no return do not count. Several other plays only count as one-half of a play. These include incomplete passes, touchdowns, field goals, out-of-bounds, safeties, change of possession plays (fumbles, interceptions, punts, kickoffs and safety kicks) as well as penalties and plays with injuries.

The game is played as follows: A type of play is chosen, e.g., outside run, inside run, short pass, etc. and reference is made to the respective chart which contains the result for that play. For the play which has been chosen, reference needs to be made to the field section at which the team is located. For example, if the offense has the ball on the defendant's 45 yard line and an outside run is called, then one refers to the outside run offensive yard 16 yard line to defensive yard 35 yard line section of playing charts, i.e., chart 94, for the result. Under that section, one locates the column for the offensive rating, A, B or C of the team in comparison to the defensive rating of the defensive team. Since the column is sub-divided into "1" and "2", then the "1" column is utilized for the first half of the game, i.e., the first and second quarters, and the "2" column is used for the second half of the game and any overtime quarters. On an outside running play, as well as on an inside running play or a draw play, a ball carrier is selected and the dice are rolled to obtain a number ranging from 11 to 88. That number is then checked with the ball carrier's card in order to find a corresponding number under his "R" column. For example, if John Doe of FIG. 3 is the ball carrier and a 31 is rolled with the dice 50, the number 17 is obtained. That number is then checked with the respective chart in order to obtain a yardage result. Note that a minus sign (–) in front of the result indicates a loss of yardage on the play.

In contrast, if a pass play is attempted, the dice are rolled and reference is made to the offensive teams receiver list to determine the receiver. For example, if there is a long pass attempted by Seattle, reference is made to the Seattle individual lists under long pass and the dice are rolled until the dice roll indicates an intended receiver who is in the game for that play. In other words, the dice are rolled to obtain a number between 11 and 88, for example 43, and according to the list, the pass would be to wide receiver Blades, assuming that he is in the game. Another dice roll is then made using the passer's card, a numerical result is obtained and that number is then utilized on the long pass play chart, dependent on the field location from which the long pass play is attempted. Completed passes are indicated by a number with a dash (–) followed by another number. The first number indicates how far downfield from the line of scrimmage the intended receiver caught the pass and the second number indicates how far the intended receiver ran after catching the pass. E.g., in chart 112 row 8 under column A the 5-6 would indicate that the pass was completed five yards downfield and that the receiver ran an additional six yards before being tackled. A negative number followed by another negative number indicates that the pass was completed behind the line of scrimmage and that the receiver lost additional yardage after the catch.

When the chart indicates that the pass was completed for a long gain then the passer's long gain number 1, 2 or 3 (shown on the passer's card) is referred to. The long play charts are then used with the appropriate LG number listed on the passer's card. The dice are rolled and they are combined in order to determine the results of the play. Any completed pass gaining yardage that would cross the goal line is a touchdown. On any pass play, any negative yardage above the chart number 23 indicates that the pass was completed for a loss. Any negative number between chart numbers 32 and 39 indicates a sack. The letters INT followed by a number indicates that the pass may have been intercepted. In this case, one needs to refer to the intercepting team's reception range in the score sheet and the dice are rolled. If the dice roll is within the defensive team's range, then the pass has been intercepted. Otherwise the pass is incomplete.

For example, INT-3 would indicate the use of column 3 in the interception table 142 which is partially reproduced in FIG. 18.

The dice are then rolled and it, e.g., 18 is the result then that translates to a 20 on the interception sheet. This indicates that the pass was intercepted 20 yards downfield. The defensive team would then roll the dice to determine which player intercepted the pass using the team's interception list. For example if Seattle intercepted the pass and 63 was rolled then Jenkins intercepted the pass. The dice would then be rolled again and use would be made of the "R" column on Jenkins' card and the intercepted pass return chart for the results. Negative numbers on the interception table would indicate that the pass was intercepted behind the line of scrimmage. The defense may, under these circumstances, choose to let any intercepted pass fall incomplete.

The letters "QF" in the pass charts, e.g., in chart 112 at row 39, column A indicate that the quarterback has fumbled the ball. The letters "QR" indicate that the quarterback could not find any open receiver and must run with the ball. In this case, the dice are rolled again using the quarterback's "R" (or run) column and the outside running play chart for results. In order to obtain a result, the offensive team's grade for running plays is utilized. It should be noted that the offensive team's grade may be adjusted by the receiver's grade except on third and fourth downs.

As mentioned, on occasion a play result will be listed as LP, MP, SP, SCP or LR. When a long play, medium play, short play or screen pass occur, then the long play table needs to be referred to and the passer's LG number is utilized. For example, in chart 122 at row 2, column A, the designation MP is there shown. Let us also assume that the passer's long gain number, which could be either 1, 2 or 3, is in this case 2. Then, one would refer to the long play table illustrated partially in FIG.

19 and column MP-2 since this is a medium pass and as mentioned the passer's LG number is 2 for the result. The dice are then rolled and the numbers obtained are combined for the play result. Using the above example, let's assume that the dice roll is a 5. Under the MP-2 column for the 5, the result is 23-31. This indicates a pass completion 23 yards downfield from the line of scrimmage with the receiver gaining an additional 31 yards for a total pass completion of 54 yards.

Similarly, on run chart 82 at row 1, column A, the designation LR (long run) is there shown. When LR occurs on the run sheets, one needs to refer to the long play table partially illustrated in FIG. 20. Also, the ball carrier's long run number must be utilized. In the cards illustrated in FIG. 3, the long run number for fullback John Doe is a 3.

For example, an outside run play was called and the chart in question indicates LR as the result. The ball carrier's LR number is 3. Reference then needs to be made to the long play table column LR 3 since this is a run and the ball carrier's LR number is 3. The dice are rolled and combined with the play result. Using the above-example and assuming the dice roll is 9 under the LR -3 column, one finds 31 as the play result. This indicates a gain of 31 yards by the ball carrier.

It should be noted that substitution during the game may alter a team's offensive grade index. Substitutions must be made before a play is called with the offense announcing its substitutions first.

For both running and pass plays the charts of FIGS. 5-10 may indicate the numbers 41, 44, 45, 46, 47 or 48. These may indicate a play with penalties, injuries and/or both. For example, in row 48 of chart 132 in FIG. 10, it can be seen that column 2B indicates a long pass play in which the pass traveled 45 yards from the line of scrimmage, the pass receiver ran for another 21 yards and there was a penalty called as well as an injury.

Certain results such as 42 and 43 are indicated by FC followed by a number, e.g., FC 3. The number listed under the FC column will indicate the yardage from the line of scrimmage that the fumble occurs. A portion of chart no. 145 of FIG. 12 is reproduced in FIG. 21. As can be seen, if a 28 is rolled under the column FC 3, the result indicates that the fumble was recovered 5 yards downfield. The question of which team recovered the fumble is determined by the offensive and defensive teams' fumble range and a dice roll needs to be made.

If the roll is within the offense's listed range then the offense retains possession of the ball whereas if the roll is within the defense's listed range then the defense would recover the ball. Thus if Houston has the ball and the roll is within the range of 51 to 88, Seattle recovers the fumble, whereas if the roll is in the range of 11 to 48 the Houston retains possession.

With a result of 43 on a player's card a fumble may have occurred but first one needs to refer to the offense's fumble range number listed in the fumble section of the score sheet and the dice need to be rolled. If the dice roll is within the range of 11–48 then a fumble has occurred. One then proceeds as outlined above. Dice then need to be rolled again and reference needs to be made to the injury and fumble recovery table to determine which player has recovered the fumble. If the dice roll is within the range of 51–88 then a fumble has not occurred. The player would then roll the dice again in order to ascertain the result of the play. If the play result indicates that a fumble has occurred only after the player has crossed the opponent's goal line then the fumble result is disregarded. A fumble that occurs in the offensive team's end zone and is recovered by the offense results in a safety as in the normal game of football. If a fumble occurs during a fumble recovery return then one needs to use the fumble range of the team that last had possession of the ball to determine which team recovers the ball.

Certain play results are followed by the letters X or XX. These results indicate that one or two penalties may have been called during that play. One then needs to refer to the penalty section of the score sheet for the range of the teams involved. In FIG. 4 it is shown that Houston's range is 11 to 48 and Seattle's range is 51 to 88. If a penalty occurs during a play, the dice are rolled to determine which team is penalized. Then a penalty chart is referred to for the type of play that was occurring when the penalty was called. Then it is determined which team the penalty was called against and the dice are rolled. The dice are then added to obtain the type of penalty. A portion of the penalty chart 146 is reproduced in FIG. 22. For example, assuming the penalty had been called against the defense on a running play and the dice roll was 5, one refers to the penalty chart under running plays and using the defense column the number 31 appears next to the dice roll of 5. On a separate chart are listed offensive (preferably 21) and defensive (preferably 18) penalties. On the section listing the defensive penalties (partially illustrated FIG. 23), the number 31 is listed as being unnecessary roughness. When two X's appear, two penalties have been called during the play. If both penalties are against the same team then the opposing team can accept either one of those penalties but not both. If the penalties have been called against each team then the play result is ignored and the down is replayed.

Injuries are designated by the letter I. If one or two I's are present following any play result it indicates that one or two players have been injured on the play. To determine who has been injured, one needs to refer to the injury and fumble recovery table.

One die is rolled. An odd number indicates that an offensive player has been injured while an even number indicates that a defensive player has been injured. Then one refers to an injury duration table partially illustrated in FIG. 24.

INJURY DURATION TABLE

When a play result indicates that an injury has occurred then roll one die. An even numbered roll indicates that a defensive player has been injured. An odd numbered roll indicates that an offensive player has been injured. Then refer to the INJURY AND FUMBLE RECOVERY TABLE and roll both dice to determine which player has been injured. No more than two players can be injured during one play. If one player is indicated for more than one injury during a play, then roll the dice just once to determine the duration of his injury. Refer to the players INJURY NUMBER (listed on his card) and the corresponding column above.

When a player is injured he must be removed from the game for 1 play at all times, regardless of his INJURY NUMBER. To determine the extent of the injury use the column that matches the injured player's INJ rating. For example in FIG. 3, John Doe has an injury rating of 3.

On rare occasions, a play result will be a C followed by a number such as C-5. When this occurs, one needs to refer to the blooper play instructions for results.

After locating the specific chart (there are preferably 22 such charts C-1 to C-22) for C-5 partially illustrated in FIG. 25. The two dice are rolled and the numbers are combined. Usually the blooper play booklet will provide the result. However, the chart will sometimes direct you to another chart or instruct you to use a completely different play.

Figure 13A:
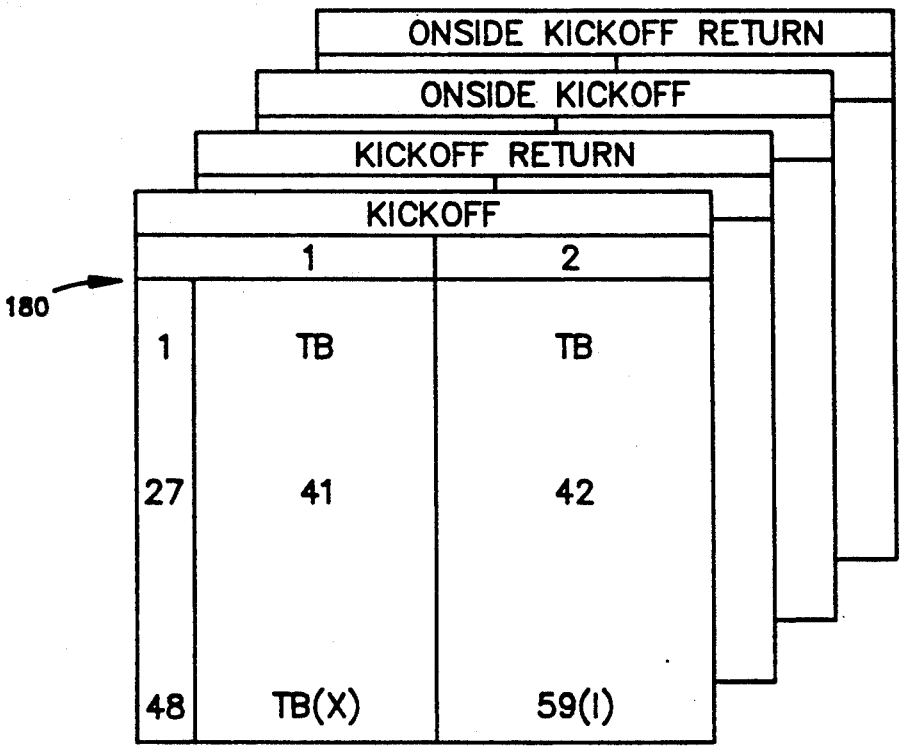
FIGS. 13A–13C are plan views of a set of charts used in the kicking phase of the game.
Figure 13B:
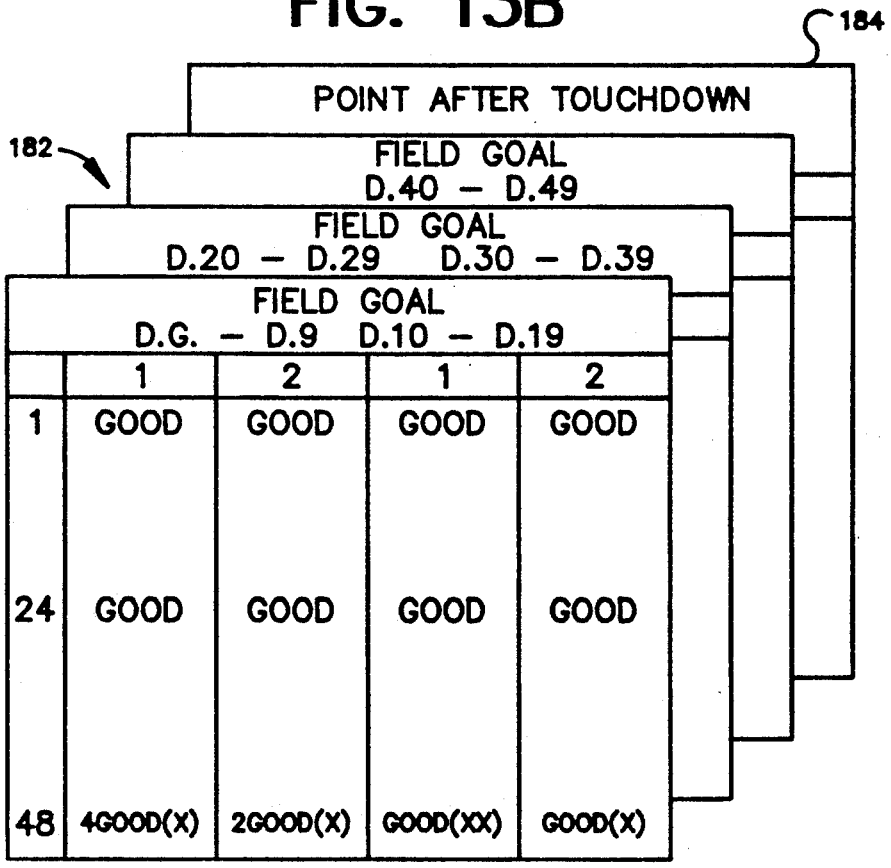
Figure 13C:
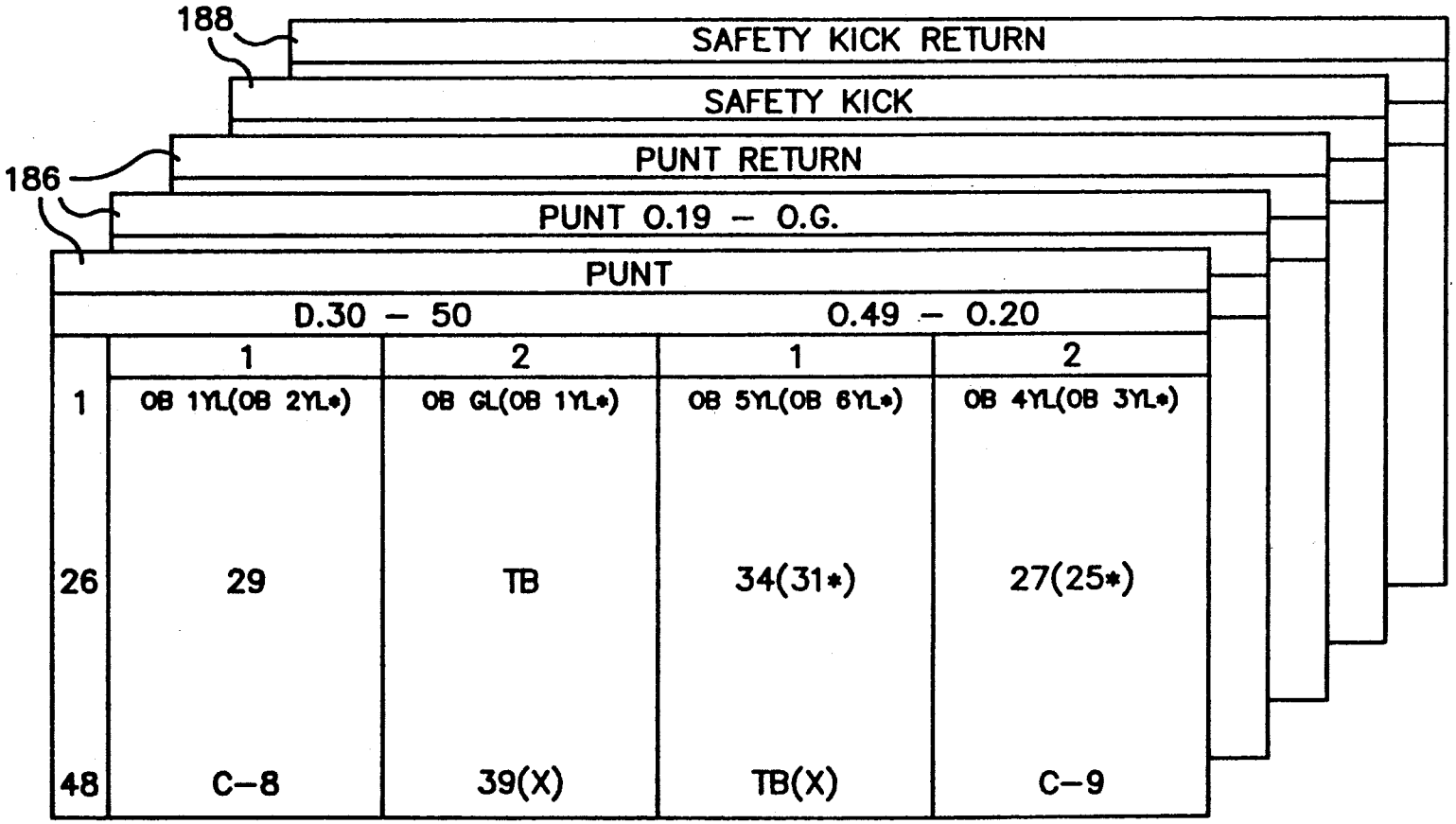

In order to simulate the kicking game, extra points and field goals with the game apparatus, a separate series of charts are utilized as shown in FIG. 13A–13C. In this regard, FIG. 13A illustrates a series of kickoff charts 180; FIG. 13B illustrates a series of field goal charts 182 and a point-after-touchdown chart 184 and FIG. 13C illustrates a set of punt charts 186 and a pair of safety kick charts 188. Alternatively, a team may attempt a fake field goal during which the holder or kicker may run or pass. As mentioned, punts are attempted during the game. The punt can either be returned or be blocked or roll out of bounds. A fake punt can also be called on fourth down. Kickoffs are provided for in the game by a kickoff section of the game. Safety kicks are also provided in the game when a safety has been scored. An on-side kickoff can be attempted at any time in place of a regular kickoff.

In addition, the player may select up to four optional plays per team per game. Such optional plays include the end around, a non-quarterback pass or a quick kick. These are dependent upon the skill ratings of the players involved.

Figure 14B:
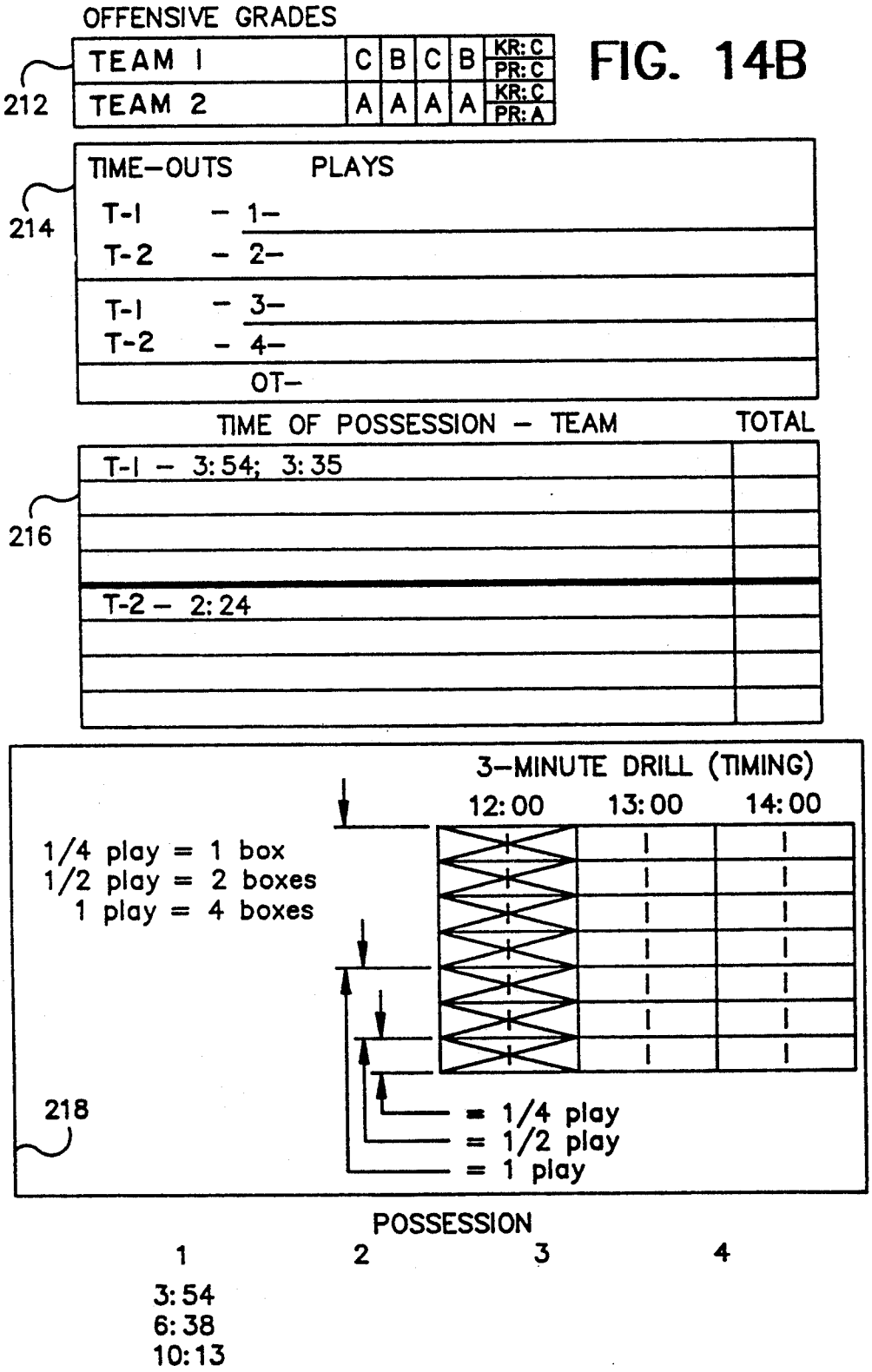
Figure 16:
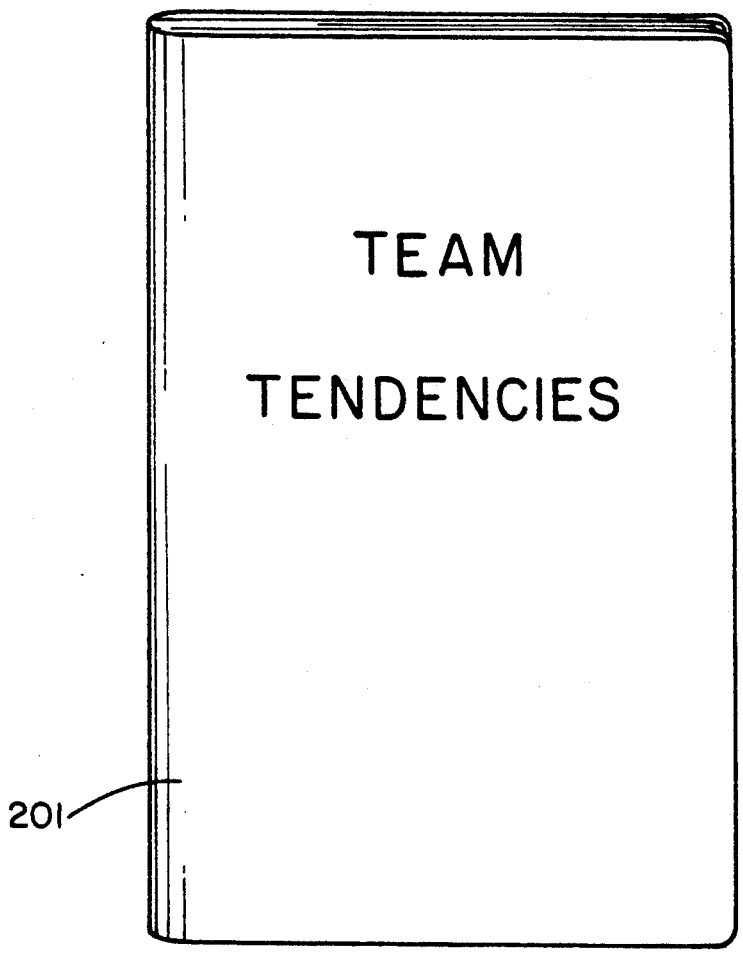
FIG. 16 is a plan view of a team tendencies booklet according to the present invention.

With reference now also to FIGS. 14A and 14B, illustrating another scoresheet 200, according to an alternate embodiment of the invention, an advanced game can also be played. In this case, a team tendency booklet 201 (FIG. 15) needs to be referred to when determining the offensive and defensive grades of the teams. In the regard, reproduced in FIG. 26 is the information on the team tendencies of Houston and Seattle. For example, in the sample score sheet, Houston has a visitor disadvantage of −4 while Seattle has a home field advantage of +4 as shown in block 202. These figures are subtracted from Houston and added to Seattle in the adjustment total section 208 of the score sheet. In addition, the team tendency booklet is referred to for quarter adjustments for the two teams. In the example, Houston has a −5 in the first quarter and +5s in the second and fourth quarters on offense and no adjustments in defense whereas Seattle has a −5 adjustment on defense in the second quarter and a +5 on offense in the second quarter, as shown in block 204. Again, the fumbles, penalties, sacks and interceptions are determined for each team as shown in block 210.

The fumble numbers for Houston are 56 on offense and 46 on defense whereas for Seattle they are 44 on offense and 53 on defense. When a team is on offense and a fumble has occurred, then the fumble range of the team is referred to. The dice are rolled and if the die roll is between 11 and 48 for Houston and 11–45 for Seattle, inclusive, then the offense retains possession of the ball. For a roll of 51 through 86 for Houston and 46–84 for Seattle, the defense recovers the ball.

Next, reference is made to the penalty section of the scoresheet 200. The visiting team, Houston, is written in the upper box and the home team, Seattle, in the lower box of the penalty section. Houston's penalty number is 49 and Seattle's penalty number is 53. The range of the teams is determined. When a penalty occurs, the dice are rolled. If the roll is between 11 and 44 for Houston then a penalty is on Houston, while a dice roll of 45 through 82 would indicate the penalty on the home team, Seattle. For a dice roll of 83–88, the dice would need to be rolled again. Reference then is made to the penalty chart 146 to determine the type of penalty.

Next, the sack section of the sheet of FIG. 14A is filled out. The sack range is determined. If the sack result occurs, a number between 32 and 39 (on any of the pass sheets 112, 114, 116, 118, 122, 124, 126, 128, 132, 134, 136 and 140) which indicates a zero or a negative number, for example, row 39 in chart 112 column ! (first half), B (Offense) in FIG. 8, the dice are rolled. If the dice roll is between 11 and 72, for Houston, or all for Seattle a sack has occurred. The dice are rolled again to refer to the team's sack list to determine who made the sack. If the dice roll is between 73 and 88 for Houston, the Seattle quarterback breaks the tackle. In that case, the dice are rolled again and reference is made to the quarterback card and in that card to the "R" column in order to determine the result of the play.

Thereafter, the interception section needs to be filled in for Seattle and Houston on the score sheet 200. If an interception result occurs, the dice are rolled. Thereafter, an interception occurs when the dice roll is between 11 and 45 for Houston. For Seattle an interception occurs whatever the dice roll since Seattle's range is 11–88. If the dice roll is between 46 and 88 for Houston then no interception occurs and instead the pass is incomplete.

The adjustments from blocks 202 and 204 are utilized in the adjusted total rating block 208 to give final offensive and defensive grades to the two teams by quarter. These grades will then determine which of columns A, B and C are to be used on the play charts of FIGS. 5–10. Block 210 of the scoresheet 200 illustrates the various fumble, penalty and sack categories for Houston and Seattle. As shown in FIG. 14B, block 212 shows the final offensive grades for Houston and Seattle and block 214 shows the plays per quarter and time outs, as in the basic game. If desired, one could also calculate the times of possession of each team on each of their drives as shown in block 216.

Finally, block 218 shows the three minute drill and use is made of the charts 219 of FIG. 11. Under the three minute drill timing section 218 of the score sheet 200, count can be made of the number of plays. The three minute drill section of the scoresheet is divided into two halves, the left side column being for the first half of the game and the right side column being for the second half of the game. For example, assuming that 24 plays have been completed in the second quarter, the three minute drill is then utilized. On the first play the pass is incomplete. Since an incomplete pass counts as one quarter play, an X is marked through one box directly under "12". Suppose the next play is a pass completed in bounds, this counts as ½ play and an X is therefore marked through the next two boxes in the timing section. On the next play a penalty is called which counts for ¼ play and therefore only one box is marked off. When the 12 minute section is full one goes to the 13 minute section and the same process is repeated until it too is filled up.

Also provided in the game are a series of timing conversion charts, each of which is partially reproduced in FIG. 27.

In the advanced game, one can also take weather into consideration. The weather footnote section 220 of the score sheet 200 is utilized if the game is effected by weather. If, for example, there is heavy rain, then the offense loses 7 rating points on all long passes and 4 rating points on all other types of passes. Also in this circumstance, the field goal attempts may be limited to 53 yards or less. In order to determined if weather will play a part in the game, one needs to refer to a weather conditions chart 230 illustrated in FIG. 15. Each stadium is rated as an A, B, C, or D per the week of the season being played, (i.e., 1-16 and play-off). Ratings A B and C also have columns 1 and 2. The first through the tenth weeks are shown in column 1 whereas the eleventh through the sixteenth weeks and the play-offs are in column 2. The exception to this is when a stadium has a weather rating of D and in this case, all of the weeks of the season utilize the same column. Also, a dice roll column is provided for all the dice roll combinations between 11 and 88 capable of being rolled by the dice 50. As is evident, should the resultant dice roll be 44 and column C1 be in effect, weather conditions 1 and 7 would apply. One would then refer to the weather chart footnotes partially reproduced in FIG. 28.

As in the basic game the offensive grades are computed for the teams. In the advanced game, however, the offensive grades may vary with each quarter. The kickoffs and punt return grades are also calculated.

As in the basic game, one would choose a type of play, e.g., outside run, inside run, short pass, medium pass, etc., and the game would be played much along the lines outlined above with respect to the basic game. However, once 24 or more plays have been completed, a three minute drill can be engaged in the second and fourth quarters and any overtime quarter.

Use of the team ranges for fumbles, penalties, interceptions and sacks will provide truly realistic results for each pro team. Such team ranges will insure that a team that has a tendency to recover more fumbles than it loses will also have the same tendency in the football game. Likewise a team that is penalized more often will also have this tendency during the game. The fumble and penalty range is assigned as follows. For example, if San Diego is visiting Detroit, San Diego's penalty number is 53, while Detroit's penalty number is 49. Since San Diego is the visitor, their entry in the total would be 1-53 and Detroit's would be 54-102. The sum of the two team's penalty numbers is 102 which would indicate using column F 97-112 on the indicator chart. 53 is located on the indicator chart under column F and in row 46. Therefore, this corresponds to rolls 11-46. 102 on the indicator chart under column F is found to be row 82. Therefore Detroit's range would be 47 to 82.

The receiving team may decline to attempt a punt return in order to avoid the possibility of a fumble. If the punt would have been fielded by the returner, the catch is ignored and twelve yards is added to the distance of the punt in order to determine the spot where the ball is downed. However, if the additional twelve yards will take the punt into the end zone and the punt is considered to be down on the two yard line.

Late in either half, the quarterback may elect to fall on the ball after the snap, rather than risk a fumble. When it is decided to have the quarterback to fall on the ball, this results in a two yard loss and counts as one full play for timing purposes, unless the defense calls a time out. Also, if the game is being played in any kind of inclement weather conditions, the dice must be rolled. If the roll is a 41, then the ball has been fumbled two yards behind the line of scrimmage. One then would need to refer to the fumble recovery procedures in order to determine which team has recovered the fumble.

Another adjustment which can be made to add realism to the game is a ball control adjustment. For this adjustment, one would compare the total time of possession for each team at the end of the second and third quarters. If one team has controlled the ball for eight or more minutes more than its opponent, then that team would get an additional five offensive rating points and three points would be subtracted from the opponent's offensive rating points. These adjustments would only carry over the remainder of that game.

In the advanced version of the game, it would also be possible to blitz, use nickel and dime defenses or to have the defense key on a certain offensive player for that play, both on running plays and on passing plays.

The invention has been described with reference to preferred and alternate embodiments. Obviously, modifications and alterations will occur to others upon the reading and understanding of this specification. It is intended to include all such modifications and alterations insofar as they come within the scope of the appended claims or the equivalents thereof.

Having thus described the preferred embodiments, the invention is claimed as follows:

1. A simulated football game apparatus comprising:

a gameboard on which is depicted a standard football playing field said gameboard also having a plurality of indicia outside said playing field;

a gamepiece movable on said gameboard to indicate the position of the football on said playing field;

a first set of playing cards each card representing an offensive player, each card including a group of numbers;

a second set of playing cards each card representing a defensive player, each card including a group of numbers;

chance number selector means operable on each play to produce a first number corresponding to one number of said group of numbers on said cards;

a means for determining total offensive and defensive powers of each of the two teams to arrive at a numerical result;

a team tendencies booklet indicating the relative strengths of an offense and a defense of a first team in relation to an offense and a defense of a second team of the teams facing each other wherein said team tendencies include numerical information for home field advantage, visitor disadvantage, quarter adjustments for offense and defense for each team; and, a plurality of first charts each of which is divided into a plurality of indicia bearing sections including a group of numbers for a particular play, such as a pass play attempted at a particular section of the field at which said gamepiece is positioned, the result of a given play being determined by said first number produced by said selector means, said first number corresponding to a second number, which is one of said group of numbers on one of said playing cards, said second number, in turn, corresponding to a third number, which is one of said group of numbers on one of said first charts to secure the result of a play, various columns of such third numbers being listed on said plurality of first charts, the column of said third numbers to be used being determined by the numerical result of the means for determining which, in turn, is influenced by the results obtained from the team tendencies booklet.

2. The apparatus of claim 1 wherein said chance number selector means comprises at least one die.

3. The apparatus of claim 1 further comprising long play charts for both running and passing plays, one of said long play charts being used when so indicated by an indicium located at selected ones of said numbers on one of said first charts.

4. The apparatus of claim 1 further comprising a timing means and a set of three minute drill charts which can be used during the last three minutes of either half of the football game, said charts including a means for plotting elapsed time in increments depending on the type of play called by the offensive team.

5. The apparatus of claim 1 wherein said gameboard further comprises:

a wind direction and velocity chart adapted to receive a marker to keep track of the wind during playing of the game, wherein a wind direction and velocity can adversely affect a performance of an offensive team by deducting points from a total rating of the offensive team;

a precipitation chart adapted to receive a marker to keep track of the precipitation during playing of the game, wherein precipitation can adversely affect a performance of an offensive team by deducting points form a total rating of the offensive team.

6. The apparatus of claim 1 further comprising a plurality of, second, special situation charts, such as intercepted pass return and fumble and blocked kick charts, each of said charts being divided into a plurality of indicia bearing sections including a group of numbers, a one of said special situations charts being used when so indicated by an indicium located at selected ones of said numbers on one of said first charts.

7. The apparatus of claim 1 further comprising a weather conditions chart including a plurality of indicia bearing sections, each including a group of numbers corresponding to one of the numbers which can be produced by said chance number selector means, said weather conditions chart being used before the start of the game to determine the weather conditions during the game, wherein the weather conditions can adversely affect a performance of an offensive team by deducting points from a total rating of the offensive team.

8. The apparatus of claim 1 further comprising a plurality of player individual lists, one for each team, each list including a list of players and associated with each player a group of numbers corresponding to one of the numbers which can be produced by said chance number selector means the number selected being associated with a particular player to indicate that that player made the play, such as a pass reception or an interception.

9. The apparatus of claim 1 further comprising a plurality of third, kicking game, charts, such as punting, field goal and kickoff charts, said charts being divided into a plurality of indicia bearing sections including a group of numbers, one of said third charts being used when so required by the game.

10. A football board game comprising:

a gameboard on which is depicted a standard football playing field;

a gamepiece movable on said gameboard to indicate the position of the football on said playing field;

a first set of playing cards each representing an offensive skill player on a football team, each card bearing at least one set of indicia for run, pass or kick plays, a group of numbers being located on said cards opposite each set of indicia;

chance number selector means operable on each play to produce a first number corresponding to one number of said group of numbers on said cards;

a team roster for each of two teams which are facing each other during the game, wherein a rating point is provided for each player on said roster indicating playing ability, the total of rating points for starting players on each roster being used to indicate the total offensive and defensive power of each of said two teams; and, a plurality of first charts each of which is divided into a plurality of indicia bearing sections including a group of numbers for a particular play, such as a pass play attempted at a particular section of the field at which said gamepiece is positioned, the result of a given play being determined by said first number produced by said selector means, said first number corresponding to a second number, which is one of said group of numbers on said playing card, said second number, in turn, corresponding to a third number, which is one of said group of numbers, on one of said first charts to secure the result of a play, various columns of such third numbers being listed on said plurality of first charts, a column to be used being influenced by the total offensive and defensive power determined from said team roster; and, a plurality of player position lists for each team, each list including a list of players and a range of numbers for each player, said numbers corresponding to one of the numbers which can be produced by said chance number selector means, the number selected being associated with a particular player to indicate that that player made the play, such as a pass reception or an interception.

11. The apparatus of claim 10 wherein said chance number selector means comprises two dice which have different indicia so that one of said two dice will always indicate a first number of said two digit number produced and another of said dice will always indicate a second of said two digit number.

12. The apparatus of claim 10 further comprising a team tendencies booklet indicating the relative strengths of an offense and a defense of a first team in relation to an offense and a defense of a second team of the teams facing each other wherein said team tendencies include numerical information for home field advantage, visitor disadvantage, quarter adjustments for offense and defense, and fumble tendencies, penalty tendencies, sack tendencies and interception tendencies for each team wherein the total offensive and defensive power of the two teams is adjusted by the results obtained from the team tendencies booklet.

13. The apparatus of claim 10 wherein said gameboard further comprises:

a wind direction indicium area adapted to receive a marker to keep track of the wind during playing of the game;

a precipitation indicium area adapted to receive a marker to keep track of the precipitation during playing of the game.

14. The apparatus of claim 10 further comprising a plurality of, second, special situation charts, such as intercepted pass return charts, each of said charts being divided into a plurality of indicia bearing sections including a group of numbers, a one of said special situations charts being used when so indicated by an indicium on one of said first charts.

15. The apparatus of claim 10 further comprising a weather conditions chart including a plurality of indicia bearing sections, each including a group of numbers corresponding to one of the numbers which can be produced by said number selector means, said weather conditions chart being used before the start of the game to determine the weather conditions during the game.

16. The apparatus of claim 10 further comprising a timing conversion chart which regulates, with the aid of said chance numbers selector means, how much time remains in a given quarter of a football game wherein a numerical result of said chance number selector means is used to add or subtract time from the time remaining in the given quarter of the football game.

17. A simulated football game apparatus comprising:

a gameboard on which is depicted a standard football playing field said gameboard also including weather conditions indicia located outside said playing field, wherein the weather conditions can adversely affect a performance of an offensive team during the game by deducting points from a total rating of the offensive team;

a gamepiece movable on said gameboard to indicate the position of the football on said playing field;

a first set of playing cards each representing an offensive skill player on a football team, each card including a group of numbers;

chance number selector means operable on each play to produce a first number corresponding to one number of said group of numbers on said cards; and, a plurality of first charts each of which is divided into a plurality of indicia bearing sections including a group of numbers for a particular play, such as a pass play attempted at a particular section of the field at which said gamepiece is positioned, the result of a given play being determined by said first number produced by said selector means, said first number corresponding to a second number, which is one of said group of numbers on said playing card, said second number, in turn, corresponding to a third number, which is one of said group of numbers, on one of said first charts to secure the result of a play.

18. The apparatus of claim 17 further comprising a plurality of, second, special situation charts, such as intercepted pass return charts, each of said charts being divided into a plurality of indicia bearing sections including a group of numbers, a one of said special situations charts being used when so indicated by an indicium on one of said first charts.

19. The apparatus of claim 17 further comprising a weather conditions chart including a plurality of indicia bearing sections, each including a group of numbers corresponding to one of the numbers which can be produced by said group number selector means, said weather conditions chart being used before the start of the game to determine the weather conditions during the game.

20. The apparatus of claim 17 further comprising a team tendencies booklet indicating the relative strengths of an offense and a defense of a first team in relation to an offense and a defense of a second team of the teams facing each other.

21. The apparatus of claim 17 further comprising a plurality of third, kicking game, charts, such as punting, field goal and kickoff charts, said charts being divided into a plurality of indicia bearing sections including a group of numbers, one of said third charts being used when so required by the game.

22. The apparatus of claim 17 further comprising fourth, long play, charts for both running and passing plays, one of said long play charts being used when so indicated by an indicium located at selected ones of said numbers on one of said first charts.

23. The apparatus of claim 17 further comprising a timing conversion chart which regulates, with the aid of said chance number selector means, how much time remains in a given quarter of the football game wherein a numerical result of said chance number selector means is used to add or subtract time from the time remaining in the given quarter of the football game.

24. The apparatus of claim 17 further comprising a blooper play chart, said blooper play chart being used when so indicated by an indicium located at selected ones of said numbers on one of said first charts.

25. The apparatus of claim 17 further comprising a timing means and a set of three minute charts which can be used during the last three minutes of either half of the football game said charts including a means for plotting elapsed time in increments depending on the type of play called by the offensive team.

* * * * *